US005307625A

United States Patent [19]

Junginger et al.

[11] Patent Number: 5,307,625

[45] Date of Patent: May 3, 1994

[54] METHOD AND ARRANGEMENT FOR MONITORING A LAMBDA PROBE IN AN INTERNAL COMBUSTION ENGINE

[75] Inventors: Erich Junginger, Stuttgart; Claus-Peter Pflieger, Asperg; Lothar Raff, Remseck; Eberhard Schnaibel, Hemmingen, all of Fed. Rep. of Germany

[73] Assignee: Robert Bosch GmbH, Stuttgart, Fed. Rep. of Germany

[21] Appl. No.: 921,770

[22] Filed: Jul. 30, 1992

[30] Foreign Application Priority Data

Jul. 30, 1991 [DE] Fed. Rep. of Germany ..... 4125154

[51] Int. Cl.[5] ..... F01N 3/20

[52] U.S. Cl. ..... 60/274; 60/276; 123/691; 123/696

[58] Field of Search ..... 123/688, 690, 691, 674, 123/488, 696; 60/274, 276

[56] References Cited

U.S. PATENT DOCUMENTS

| | | | |
|---|---|---|---|
| 3,969,932 | 7/1976 | Rieger et al. . | |
| 4,007,589 | 2/1977 | Neidhard et al. . | |
| 4,177,787 | 12/1979 | Hattori et al. . | |
| 4,739,614 | 4/1988 | Katsuno et al. . | |
| 4,747,265 | 5/1988 | Nagai et al. . | |
| 4,831,838 | 5/1989 | Nagai et al. | 123/691 |
| 4,912,926 | 4/1990 | Kumagai et al. | 123/691 |
| 4,947,818 | 8/1990 | Kamohara et al. | 123/690 |
| 5,092,123 | 3/1992 | Nada et al. | 123/691 |
| 5,099,647 | 3/1992 | Hamburg | 60/274 |
| 5,115,639 | 5/1992 | Gopp | 60/274 |
| 5,117,631 | 6/1992 | Moser | 123/691 |
| 5,157,920 | 10/1992 | Nakaniwa | 60/274 |
| 5,167,120 | 12/1992 | Junginger et al. | 60/274 |
| 5,168,700 | 12/1992 | Furuya | 60/274 |

FOREIGN PATENT DOCUMENTS

| | | | |
|---|---|---|---|
| 475177 | 3/1992 | European Pat. Off. | 123/691 |
| 0048756 | 3/1983 | Japan | 123/691 |
| 0205442 | 8/1988 | Japan | 123/691 |
| 0015447 | 1/1989 | Japan | 123/691 |
| 0300034 | 12/1989 | Japan | 123/690 |
| 0181046 | 7/1990 | Japan | 123/691 |

*Primary Examiner*—E. Rollins Cross
*Assistant Examiner*—Thomas Moulis
*Attorney, Agent, or Firm*—Walter Ottesen

[57] ABSTRACT

The invention is directed to a method and an arrangement for monitoring deterioration of lambda probes in the context of a two-probe control. The signal of the lambda probe forward of the converter functions to control the lambda controller and the signal of the lambda probe rearward of the converter influences the lambda controller via an actuating variable and the degree to which the controller is influenced operates for monitoring of the probe forward of the converter. With this method and arrangement, the quality and deterioration of the lambda probe forward of the converter are advantageously detected and, if required, an alarm signal is generated.

7 Claims, 4 Drawing Sheets

METHOD AND ARRANGEMENT FOR MONITORING A LAMBDA PROBE IN AN INTERNAL COMBUSTION ENGINE

FIELD OF THE INVENTION

The invention relates to a method and an arrangement for monitoring lambda probes in the context of a two-probe closed-loop control in an internal combustion engine. The signal of the probe forward of a catalytic converter serves for the actual lambda closed-loop control and, in a supplementary manner, the signal of the probe rearward of the catalytic converter influences the lambda controller via an actuating variable.

BACKGROUND OF THE INVENTION

Two-probe systems are generally already known. Thus, U.S. Pat. No. 3,969,932 discloses a method as well as an arrangement for monitoring the activity of a catalytic converter in the exhaust gas system of an internal combustion engine. Here, the probe forward of the catalytic converter operates for the actual closed-loop control; whereas, the probe rearward of the catalytic converter operates in combination with the probe forward of the catalytic converter to monitor this converter. For this purpose, changes in the output signals of both lambda probes are detected and the time delay between the two changes is evaluated as a measure of the catalytic activity.

U.S. Pat. No. 4,007,589 shows a similar arrangement. Here too, a conclusion is drawn as to the effectiveness of the catalytic converter by means of a comparison of the two probe signals.

U.S. Pat. No. 4,739,614 also discloses a two-probe system for an internal combustion engine. Here, the probe disposed upstream is used for the closed-loop control of the actual air/fuel ratio In addition, an open-loop control variable is formed in dependence upon the output signal of the probe rearward of the catalytic converter. At the end of the abstract of this patent, it is stated that the computation of the air/fuel ration is prevented when the probe disposed downstream is in an abnormal condition.

SUMMARY OF THE INVENTION

It has been shown that the known solutions do not provide optimal results in all cases. Accordingly, it is an object of the invention to recognize a control probe as being defective if the exhaust gas deteriorates beyond existing limit values. This detection is made in the context of a two-probe closed-loop control with the control probe deteriorating in the course of operational use.

It is possible to detect deteriorated lambda probes forward of the catalytic converter with the aid of the method and arrangement of the invention. Furthermore, in the initial stages of probe deterioration, the effects can be corrected by means of shifts of characteristic curves with respect to the control probe forward of the catalytic converter with an actuating variable which is derived from the probe rearward of the catalytic converter. A warning signal is emitted if the deviation of the forward probe from its normal characteristic values exceeds a specific value.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
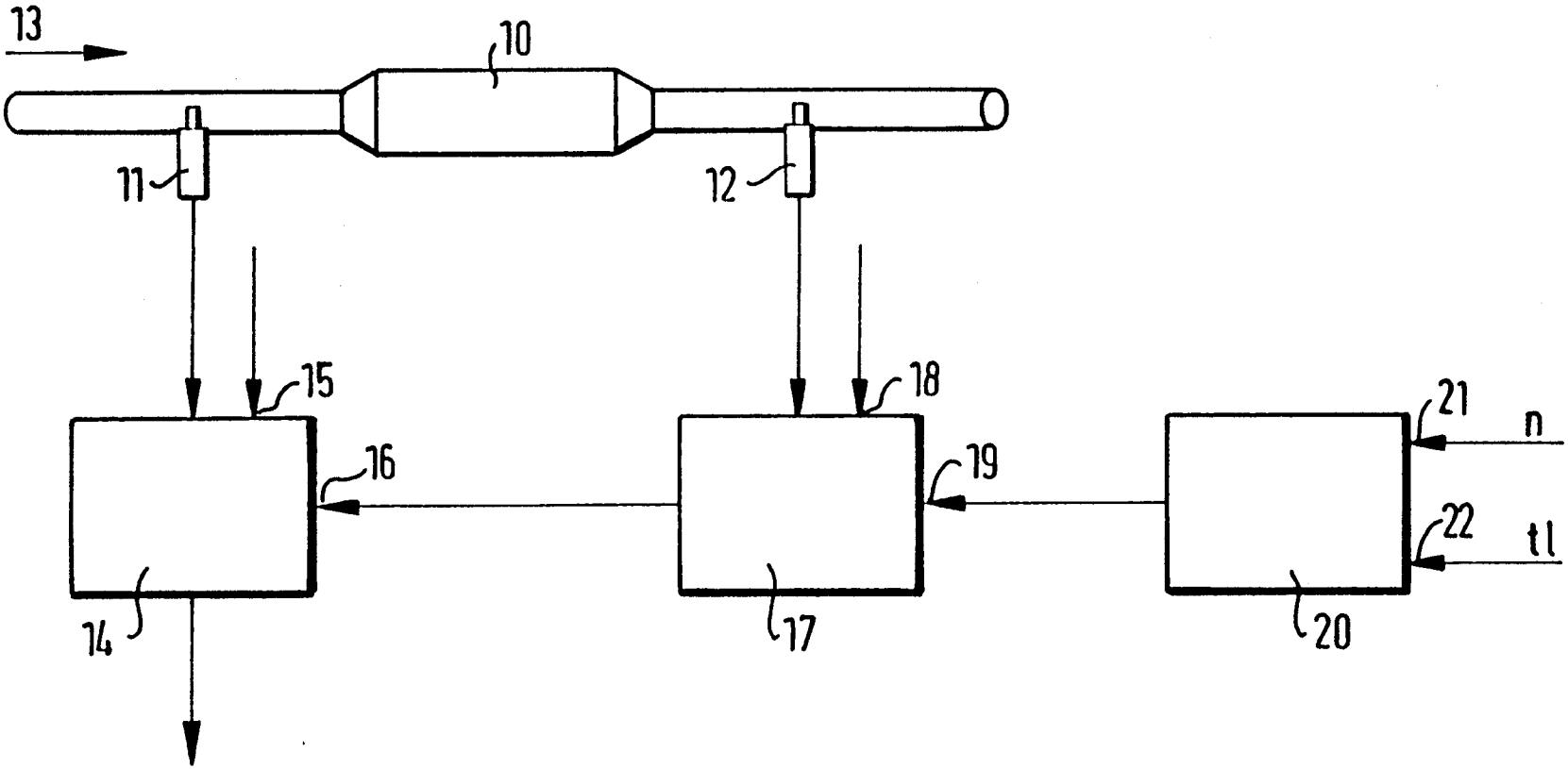
FIG. 1 is a overall block diagram of a two-probe arrangement having a catalytic converter.

FIG. 1 shows the important elements of a two-probe system in combination with a catalytic converter disposed in the exhaust gas pipe of an internal combustion engine. The catalytic converter is identified by reference numeral 10 and the probe forward of the catalytic converter is identified by reference numeral 11 and the probe rearward of the catalytic converter by reference numeral 12. An arrow 13 indicates the direction of flow of the exhaust gas from the internal combustion engine (not shown) to the catalytic converter 10 and thereafter to the probe 12 rearward of the converter. Reference numeral 14 identifies the lambda controller which makes a signal FR available at the output thereof. The signal FR is applied as a corrective variable in a fuel injection system for the engine. The lambda controller 14 receives at least the signal from the probe 11 forward of the catalytic converter as an input variable and, if required, a desired value Us via a separate input 15 with this desired value being for the output signal of the probe forward of the catalytic converter. The output signal of a controller 17 is supplied at a further input 16 of the lambda controller 14. The controller 17 receives the output signal of the probe 12 rearward of the catalytic converter in a manner analogous to the conditions with respect to lambda controller 14. The controller 17 also receives a desired value via a further input 18. A control input of the controller 17 is identified by reference numeral 19. This input 19 receives its signal from an arrangement 20 for the open-loop control of the enablement of the controller 17; whereas, the arrangement 20 itself receives an engine speed signal (n) via an input 21 as well as a load signal t1 via an input 22.

In the circuit block diagram of FIG. 1, it is essential that the lambda controller 14 effects the actual lambda control in dependence upon the output signal of the probe 11 forward of the catalytic converter. The correction signal of the controller 17 generated by the probe rearward of the catalytic converter acts as a corrective variable for this lambda controller 14. The controller 17 operates, in turn, only when specific operating conditions are present and especially operating conditions with respect to engine speed and load.

Figure 2:
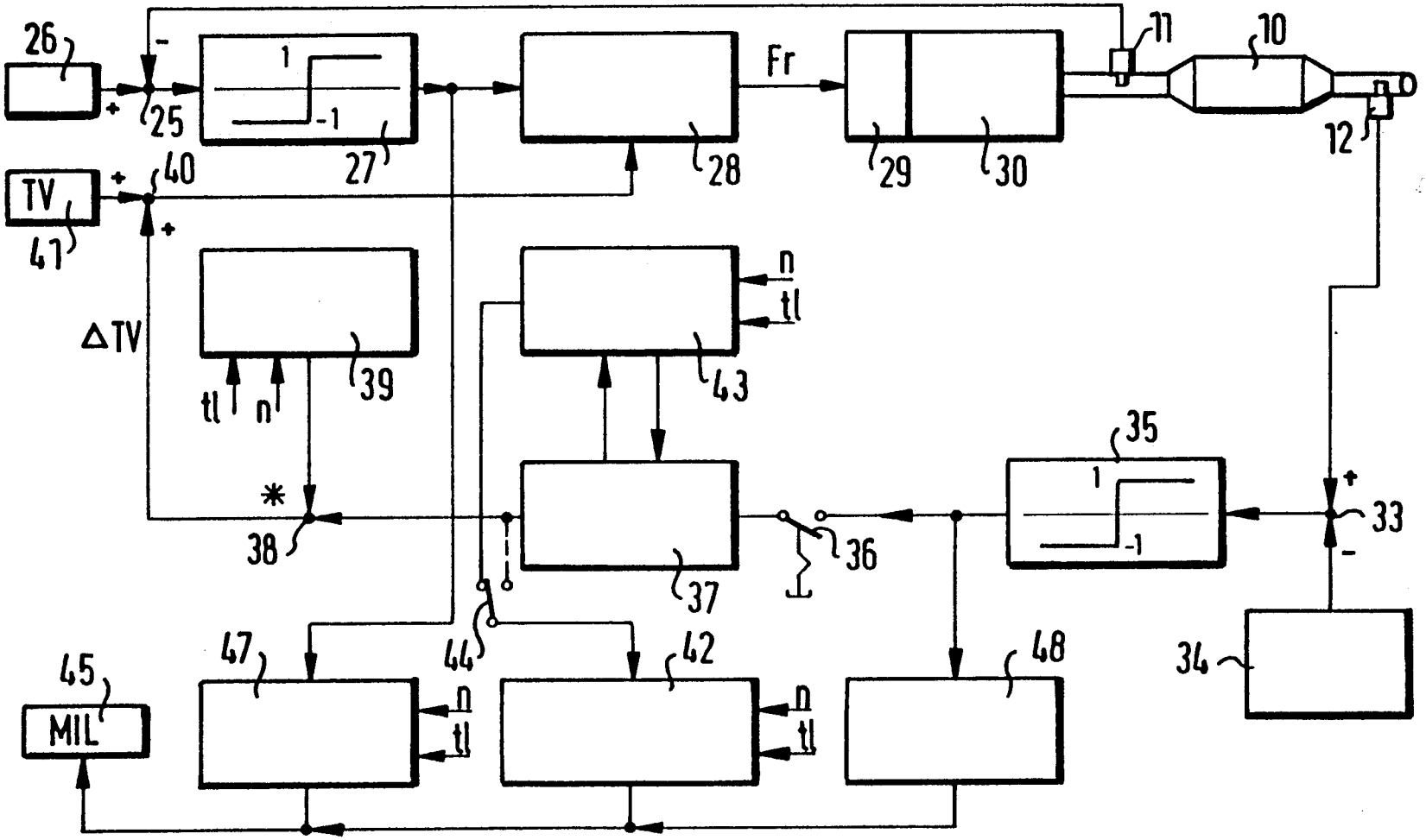
FIG. 2 is a circuit block diagram of an arrangement for monitoring the deterioration of a lambda probe by means of a rate time TV, monitoring the period duration of the signal of the probe forward of the catalytic converter as well as a possibility of monitoring the probe rearward of the catalytic converter.

FIG. 2 shows a detailed view of the arrangement of FIG. 1 together with additional elements in combination with a lambda controller as well as the monitoring of the lambda probes. In this FIG. 2, the elements corresponding to those in FIG. 1 have the same reference numerals.

The description of the subject matter of FIG. 2 is advantageously made starting with the probe 11 forward of the catalytic converter. The probe 11 supplies its output signal to a comparator 25. A desired value from a desired-value transducer 26 is also supplied to comparator 25 for the output signal of the probe forward of the catalytic converter. A threshold-value interrogation follows the comparator 25 and thereafter a somewhat more specific lambda controller 28 compared to the representation shown in FIG. 1. The lambda controller 28, in turn, supplies the lambda control factor FR at its output. This factor FR operates in the following on the basic metering in a fuel metering system 29 for the engine 30. The exhaust gas system follows the engine and has the probe 11 forward of the catalytic converter, the catalytic converter 10 itself as well as the probe 12 rearward of the catalytic converter.

The output signal of the probe rearward of the catalytic converter reaches a comparator 33 where this signal is compared to a signal from the characteristic field 34 which forms a desired value. The result of the comparison in the comparator 33 is interrogated in block 35 as to a threshold. The interrogation result is applied to an integral controller 37 via a switch 36 with the integral controller 37 corresponding essentially to the controller 17 of FIG. 1. The integral controller 37 supplies its output signal to a multiplier position 38 into which a value from a weighting characteristic field 39 is supplied in dependence upon load t1 and engine speed (n). The result of the multiplication forms a value delta-TV. This value delta-TV is added in a further addition position 40 to the value from a TV-characteristic field 41 and finally forms the corresponding input variable of the lambda controller 28 as variable TV-total.

The subject matter of FIG. 2 described up until now operates to realize the lambda control primarily with the output signal of the probe forward of the catalytic converter and to make available a corrective variable for the lambda controller by means of the output signal of the probe rearward of the catalytic converter.

The basic concept of the present invention is to evaluate the corrective signal emitted by the probe rearward of the catalytic converter so that with this corrective signal, not only can a corrective signal be generated for the lambda controller 28, but also, by means of this generated signal, a conclusion can be drawn as to the quality or usability or deterioration of the probe forward of the catalytic converter. An appropriate warning signal is emitted if the probe forward of the converter is shown to be no longer adequately usable.

Block 42 operates with respect to the foregoing. The block 42 processes either directly the output signal of the I-controller 37 or the output signal of a learning characteristic field 43. This alternative possibility is exemplified by means of a switch 44. The learning characteristic field 43 itself stores the individual values of the I-controller 37 in order, for example, to make available at a new start of the engine a particular new output basis for the I-controller. In addition, load t1 and engine speed (n) are input variables for the characteristic field 43.

If the monitoring in block 42 gives cause to characterize the probe forward of the converter as no longer being adequately usable, then an alarm signal is generated and a corresponding display 45 is activated (MIL malfunction, indicator light).

In addition, it has been shown advantageous to introduce a block 47 for monitoring the period duration of the output signal of the interrogator 27 with load and engine speed values again being considered. The starting point for the monitoring of the period duration is the recognition that probes become slower in responding with increasing deterioration so that a certain data can be made available as to the operating performance of this probe by means of the monitoring of the period duration of the switching response of the probe forward of the converter.

Finally, a monitoring of the probe rearward of the converter is provided with a block 48. This block 48 is also connected to an alarm device 45 at its output.

Figure 3:
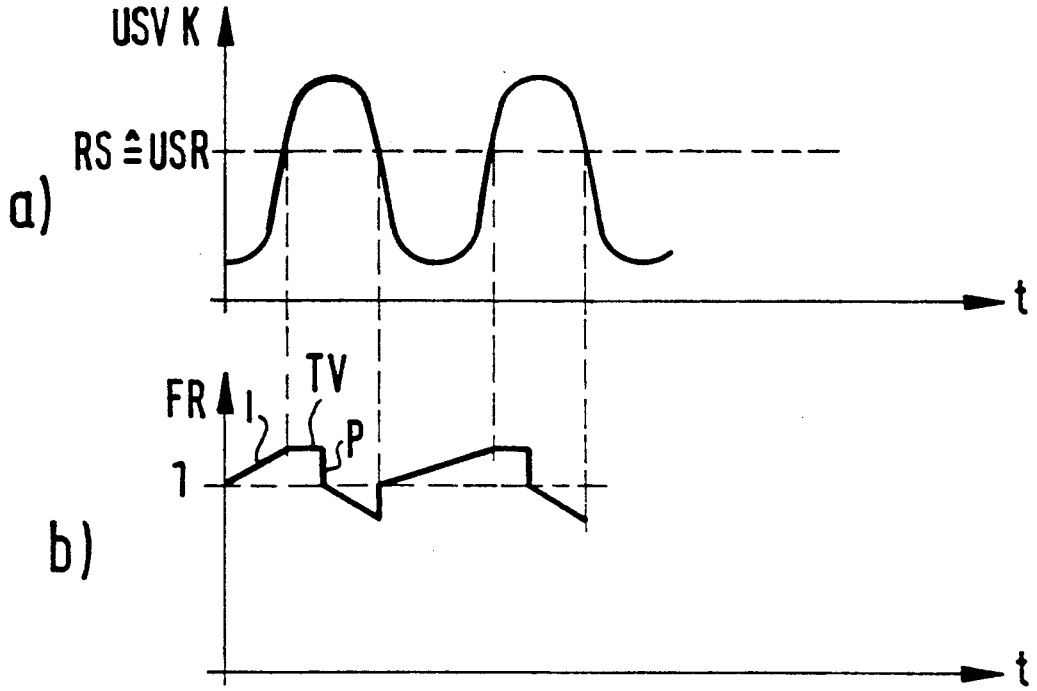
FIG. 3 shows a first curve (a) of the lambda probe voltage forward of the catalytic converter as well as a graph (b) of the control factor of the lambda controller.

In the arrangement of FIG. 2, the actual lambda control takes place in such a manner starting with the probe forward of the converter in a manner which will be described with the aid of the diagram of FIG. 3. In FIG. 3, the curve trace (a) shows the output signal of the probe forward of the converter as a function of time. With the selectable control threshold RS, which corresponds to the signal USR of block 26 of FIG. 2, an inquiry is made as to whether the probe signals a rich or a lean mixture at the individual time points.

Curve (b) shows the signal trace of the lambda controller 28 with the control factor FR as an output variable. Here it is clear that when the control threshold of the probe signal forward of the converter is reached, the integration operation in the lambda controller 28 is stopped for a specific delay time TV and only thereafter, a p-jump as well as a new integration in another direction take place. The delay time TV can be read out of the characteristic field 41 of FIG. 2 in dependence on load and engine speed. By means of this delay time TV, a lambda displacement with respect to lambda=1 is realized. Furthermore and, in correspondence to the subject matter of FIG. 2, a deviation from the optimal operation of the probe forward of the converter is compensated by the lambda displacement by means of a changed delay time TV.

As an alternate embodiment for compensating by means of a TV-intervention in the lambda controller, it can be advantageous to vary the P-jump in the lambda controller 28 (see here also curve (b) of FIG. 3) in dependence upon the particular application, to influence the control threshold USR (FIG. 2, block 26, curve (a) of FIG. 3) or however to provide an asymmetric displacement of the integrator slope of the lambda controller.

Figure 4:
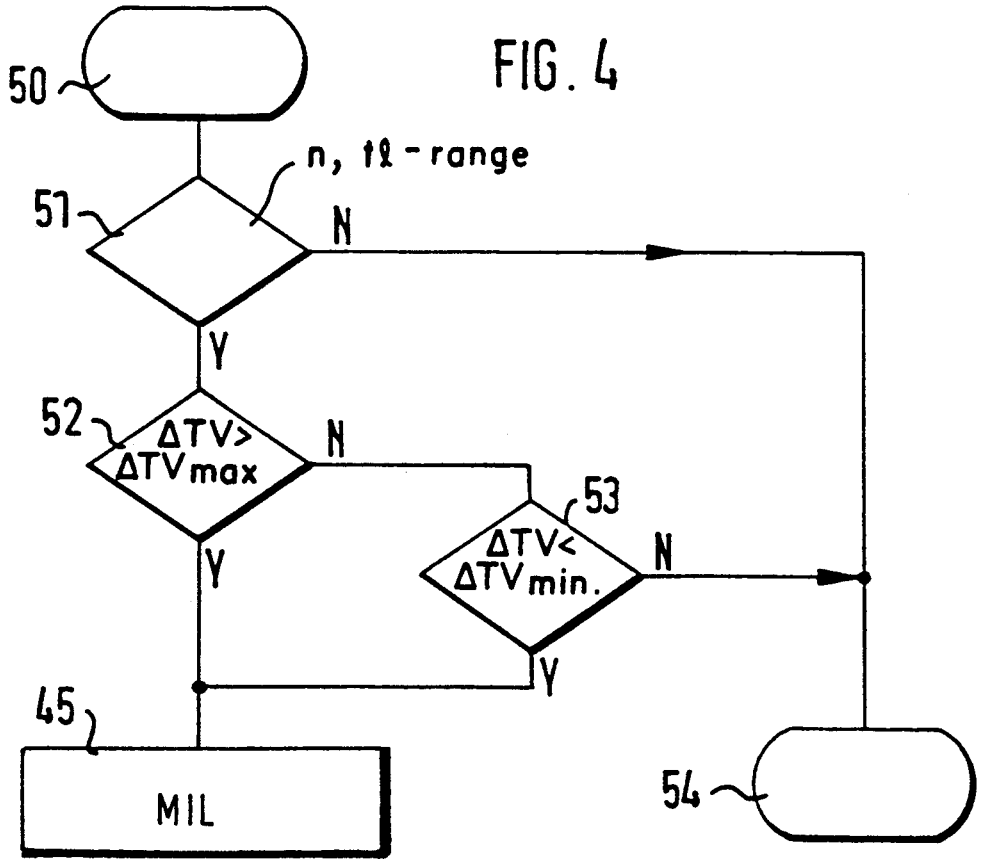
FIG. 4 is a flowchart showing the evaluation logic of the actuating variable of the integrator for the signal of the probe rearward of the catalytic converter with respect to a delta-TV-monitoring; and, FIG. 5 is a flowchart showing the evaluation logic for monitoring the period duration of the signal of the probe forward of the catalytic converter.

FIG. 4 shows an example for realizing a computer-controlled delta-TV monitoring according to block 42 in FIG. 2. After the start 50 of this subprogram, an inquiry takes place as to whether an operating range with respect to engine speed and load is present wherein a monitoring of the probe forward of the converter would be at all advantageous (inquiry 51). If this operating range is present then, in a next inquiry 52, a monitoring of the output signal of the I-controller 37 or of the corresponding value of the characteristic field takes place as to the presence of a specific upper limit. If this upper limit is exceeded, an alarm signal is emitted in block 45 of FIG. 2. If the upper limit corresponding to the inquiry 52 is not present, then a corresponding inquiry as to a lower limit value 53 takes place. With a positive result, that is the inquired value is less than the lower limit value, an alarm announcement is likewise emitted. Otherwise, this subprogram ends in "end" 54 in correspondence to the conditions when a monitoring is not necessary in accordance with the inquiry in the inquiry unit 51 of the operating range.

Figure 5:
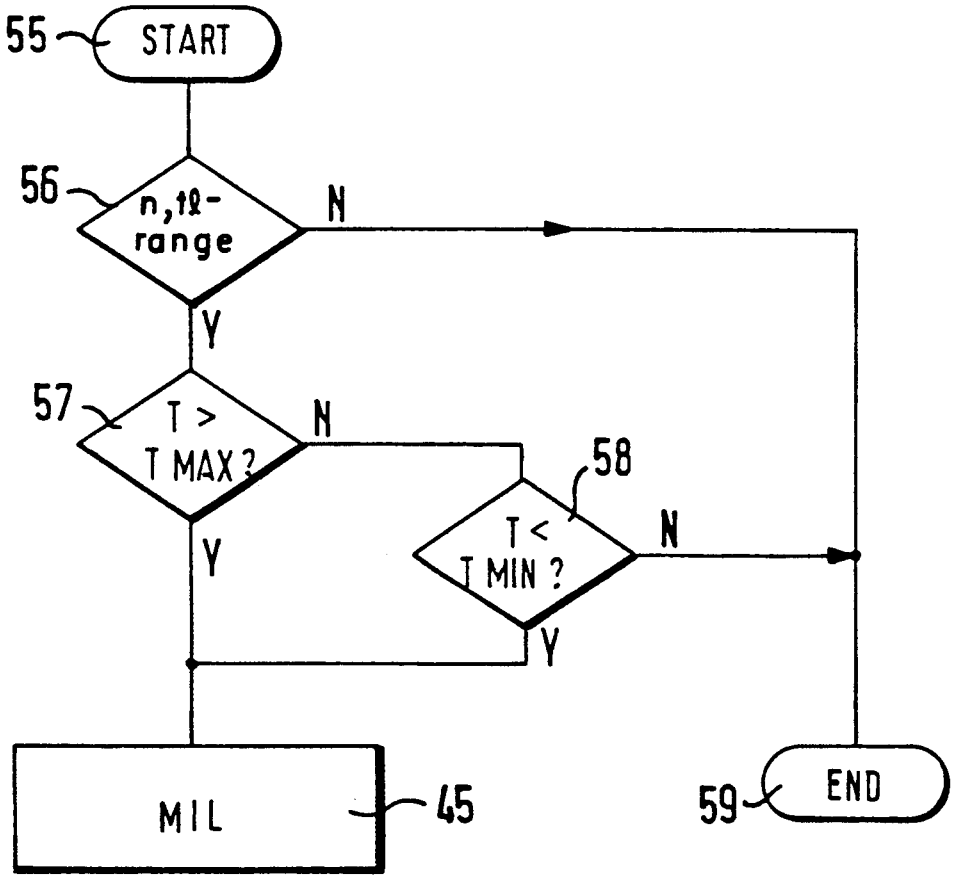

FIG. 5 shows a possibility for realizing the monitoring of the period duration of block 45 of FIG. 2. Here too, after a start block 55, an inquiry takes place as to whether a monitoring range is given (inquiry unit 56). If this is the case, the subprogram continues with an inquiry as to a maximum period duration ($T > Tmax$) in the inquiry unit 57 and, subsequently a further inquiry as to a minimum duration value ($T < Tmin$) in the inquiry unit 58. If the period duration is above the maximum value or below the minimum value, then the alarm unit 45 of FIG. 2 is likewise activated; otherwise, the program ends at 59.

The lambda controller rearward of the catalytic converter is not subjected to raw exhaust gases to the same extent as the lambda probe forward of the catalytic converter. For this reason, the lambda probe rearward of the catalytic converter deteriorates only slowly. A monitoring as precise as for the lambda probe forward of the converter is therefore not necessary. On the other hand, a greatly deteriorated lambda probe rearward of the converter effects no significant deterioration of the exhaust gas since its dynamic is practically without influence.

It is understood that the foregoing description is that of the preferred embodiments of the invention and that various changes and modifications may be made thereto without departing from the spirit and scope of the invention as defined in the appended claims.

What is claimed is:

1. A method for monitoring first and second lambda probes in the context of a two-probe closed-loop control, the first and second lambda probes being arranged forward and rearward of a catalytic converter, respectively, the method comprising the steps of:

utilizing the signal of the first probe arranged forward of the catalytic converter to serve for lambda control;

utilizing the signal of the second probe rearward of the catalytic converter to influence the lambda controller by means of an actuating variable;

utilizing the degree of the influence to monitor said first probe;

comparing the signal of said second probe to a threshold value;

integrating the comparison signal; and, utilizing the integrated signal for influencing the lambda controller.

2. A method for monitoring first and second lambda probes in the context of a two-probe closed-loop control, the first and second lambda probes being arranged forward and rearward of a catalytic converter, respectively, the method comprising the steps of:

utilizing the signal of the first probe arranged forward of the catalytic converter to serve for lambda control;

utilizing the signal of the second probe rearward of the catalytic converter to influence the lambda controller by means of an actuating variable;

utilizing the degree of the influence to monitor said first probe;

comparing the signal of said second probe to a threshold value;

integrating the comparison signal;

utilizing the integrated signal for influencing the lambda controller;

monitoring the actuating variable as to at least one of a lower limit and an upper limit when selectable operating conditions are present; and, when there is a drop below the lower limit or the upper limit is exceeded, generating a fault announcement.

3. The method of claim 1, further comprising carrying out a monitoring of the signal of said first probe.

4. The method of claim 1, wherein the actuating variable can be stored in a learning characteristic field.

5. The method of claim 1, wherein the actuating variable is formed for selectable operating conditions.

6. The method of claim 1, wherein the second probe is monitored as to a plausible output signal.

7. The method of claim 1, wherein the actuating variable can be corrected by means of a weighting variable in dependence upon the particular operating characteristic variable which is present.

* * * * *

UNITED STATES PATENT AND TRADEMARK OFFICE

CERTIFICATE OF CORRECTION

PATENT NO. : 5,307,625

DATED : May 3, 1994

INVENTOR(S) : Erich Junginger, Claus-Peter Pflieger, Lothar Raff and Eberhard Schnaibel It is certified that error appears in the above-identified patent and that said Letters Patent is hereby corrected as shown below:

In column 1, line 38: between "ratio" and "In", please insert -- . --.

In column 1, line 42: delete "ration" and substitute -- ratio -- therefor.

In column 4, line 7: delete "a".

In column 4, line 16: delete "in such a manner".

Signed and Sealed this

Sixth Day of December, 1994

Bruce Lehman

*Attest:*

BRUCE LEHMAN

*Attesting Officer*

*Commissioner of Patents and Trademarks*